US010737328B2

(12) United States Patent
Li

(10) Patent No.: US 10,737,328 B2
(45) Date of Patent: Aug. 11, 2020

(54) METHOD OF MANUFACTURING A MANGANESE BISMUTH ALLOY

(71) Applicant: FORD GLOBAL TECHNOLOGIES, LLC, Dearborn, MI (US)

(72) Inventor: Wanfeng Li, Novi, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 695 days.

(21) Appl. No.: 15/427,278

(22) Filed: Feb. 8, 2017

(65) Prior Publication Data

US 2018/0221959 A1 Aug. 9, 2018

(51) Int. Cl.

| | |
|---|---|
| ***B22F 9/04*** | (2006.01) |
| ***C22C 12/00*** | (2006.01) |
| ***C22C 22/00*** | (2006.01) |
| ***B07B 7/08*** | (2006.01) |
| ***B07B 7/086*** | (2006.01) |
| ***B07B 7/10*** | (2006.01) |
| ***H01F 1/047*** | (2006.01) |
| ***B02C 23/08*** | (2006.01) |
| *B02C 19/06* | (2006.01) |

(52) U.S. Cl.

CPC ..... *B22F 9/04* (2013.01); *B07B 7/08* (2013.01); *B07B 7/086* (2013.01); *B07B 7/10* (2013.01); *C22C 12/00* (2013.01); *C22C 22/00* (2013.01); *H01F 1/047* (2013.01); *B02C 19/063* (2013.01); *B02C 23/08* (2013.01); *B22F 2009/044* (2013.01); *B22F 2999/00* (2013.01)

(58) Field of Classification Search

CPC ..... B02C 19/06; B02C 19/069; B02C 19/063; B02C 23/08; B22F 9/04; B22F 2009/044; B22F 2999/00; B07B 7/08; B07B 7/086; B07B 7/10; C22C 12/00; H01F 1/047

USPC ..... 241/5, 39

See application file for complete search history.

(56) References Cited

U.S. PATENT DOCUMENTS

| | | | | |
|---|---|---|---|---|
| 7,789,331 | B2 * | 9/2010 | Zehavi | B02C 19/061 241/5 |
| 7,832,664 | B2 * | 11/2010 | Albus | B02C 19/063 241/39 |
| 7,850,105 | B2 * | 12/2010 | Ito | B02C 19/061 241/39 |
| 8,733,680 | B2 * | 5/2014 | Lin | B02C 19/06 241/39 |
| 8,770,499 | B2 * | 7/2014 | Kozawa | B02C 19/061 241/16 |
| 2003/0096115 | A1 * | 5/2003 | Kozaki | G03G 9/08755 428/404 |

(Continued)

OTHER PUBLICATIONS

Rama Rao Influence of jet milling process parameters on particles size, phase formation and magnetic properties of MnBi alloy (Year: 2014).*

*Primary Examiner* — Shelley M Self
*Assistant Examiner* — Smith Oberto Bapthelus
(74) *Attorney, Agent, or Firm* — David Kelley; Brooks Kushman P.C.

(57) ABSTRACT

A method of increasing volume ratio of magnetic particles in a MnBi alloy includes operating a jet miller fed with a MnBi alloy powder containing magnetic particles and non-magnetic particles with gas flow parameters selected such that, only for the magnetic particles, a gas drag force is greater than a centrifugal force within the jet miller to separate the magnetic particles from the non-magnetic particles.

15 Claims, 3 Drawing Sheets

(56) References Cited

U.S. PATENT DOCUMENTS

| | | | | |
|---|---|---|---|---|
| 2005/0127214 | A1* | 6/2005 | Martens | B01J 8/42 241/5 |
| 2013/0186993 | A1* | 7/2013 | Yoshikawa | B02C 19/066 241/79 |
| 2014/0291296 | A1* | 10/2014 | Jin | B23H 1/04 219/69.16 |
| 2015/0325349 | A1 | 11/2015 | Gabay et al. | |
| 2016/0035487 | A1 | 2/2016 | Kim et al. | |
| 2016/0093425 | A1* | 3/2016 | Li | H01F 1/0577 419/30 |
| 2018/0221959 | A1* | 8/2018 | Li | B22F 9/04 |
| 2018/0366247 | A1* | 12/2018 | Li | H01F 1/0557 |

* cited by examiner

METHOD OF MANUFACTURING A MANGANESE BISMUTH ALLOY

TECHNICAL FIELD

The disclosure relates to a manganese bismuth (MnBi) alloy and a method of producing the same, a method of increasing volume ratio of magnetic phase in a MnBi material, and a method of separating magnetic and non-magnetic phases in a MnBi alloy.

BACKGROUND

MnBi alloys have been identified as a suitable substitute for rare-earth-free permanent magnets because of their unique properties such as high coercivity which increases with temperature. But obtaining a MnBi alloy having high purity of the magnetic low-temperature phase (LTP) remains difficult, partially because the reaction between manganese (Mn) and bismuth (Bi) is peritectic.

SUMMARY

A method of increasing volume ratio of magnetic particles in a MnBi alloy is disclosed. The method may include operating a jet miller fed with a MnBi alloy powder containing magnetic particles and non-magnetic particles with gas flow parameters selected such that, for the magnetic particles, a gas drag force is greater than a centrifugal force within the jet miller to separate the magnetic particles from the non-magnetic particles. The magnetic particles include low temperature phase MnBi particles. The gas flow parameters may include pushing nozzle pressure, grinding nozzle pressure, miller cut size, or a combination thereof. For a given miller cut size, the magnetic particles are being separated from the non-magnetic particles as long as the pushing nozzle pressure and the grinding nozzle pressure fall within a predefined set of values. The grinding nozzle pressure may have a lower limit than the pushing nozzle pressure. The drag force and centrifugal force may act on the particles in the jet miller. The MnBi alloy may be crushed and have a particle size between about 1 μm and 500 μm. The magnetic particles may have a smaller diameter and lower density than the non-magnetic particles. The separated magnetic particles may include up to 95 volume % magnetic phase. The operating may be conducted for a predefined time period.

In another embodiment, a method of separating magnetic and non-magnetic phases in a MnBi alloy is disclosed. The method may include operating a jet miller fed with a MnBi alloy powder containing magnetic particles and non-magnetic particles with gas flow parameters selected such that, for the magnetic particles, a gas drag force is greater than a centrifugal force within the jet miller. The method may also include operating a jet miller such that for non-magnetic particles, the gas drag force is lower or equal to the centrifugal force within the jet miller to separate the magnetic particles from the non-magnetic particles. The method may include collecting the separated magnetic particles, and wherein the magnetic particles comprise low temperature phase MnBi particles. The gas flow parameters may include pushing nozzle pressure, grinding nozzle pressure, miller cut size, or a combination thereof. The method may include adjusting the selected gas flow parameters during the separation. The adjusting may be gradual. The method may also include collecting the non-magnetic particles, combining the non-magnetic particles with Mn to form a powder mixture, annealing the powder mixture to obtain a MnBi alloy comprising magnetic and non-magnetic phases; and crushing the MnBi alloy to form a crushed powder and repeating the operating step with the crushed powder to separate the magnetic and non-magnetic phases.

In a yet alternative embodiment, a method of producing a MnBi alloy including up to 97 volume % magnetic phase is disclosed. The method may include operating a jet miller fed with a MnBi alloy powder containing magnetic particles and non-magnetic particles with gas flow parameters selected such that, only for the magnetic particles, a gas drag force acting on the magnetic and non-magnetic particles is greater than a centrifugal force acting on the magnetic and non-magnetic particles within the jet miller to separate the magnetic particles from the non-magnetic particles. The method may also include collecting the magnetic particles having up to 95 volume % of magnetic phase. The method may include repeating the operating step with the magnetic particles to increase volume % of the magnetic phase to up to 97 volume %. The gas flow parameters may include pushing nozzle pressure, grinding nozzle pressure, miller cut size, or a combination thereof. The grinding nozzle pressure may have a lower limit as compared with the pushing nozzle pressure. The method may further include changing the selected gas flow parameters before repeating the operating step. The changing may include lowering at least one of the gas flow parameters. The magnetic particles may have a smaller diameter and lower density than the non-magnetic particles.

In another embodiment, a MnBi alloy comprising at least about 95 to 97 volume % magnetic phase produced by the method described above is disclosed.

DETAILED DESCRIPTION

Figure 1:
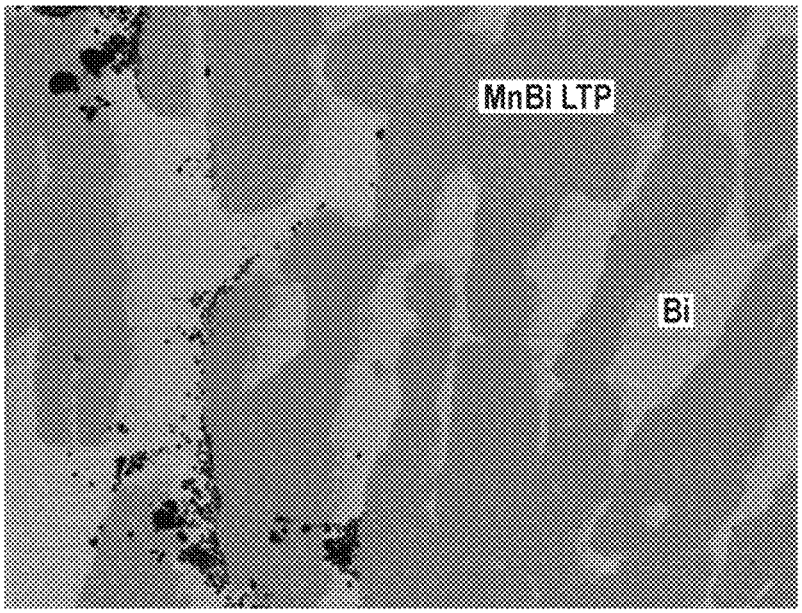
FIG. 1 (PRIOR ART)
FIG. 1 depicts a SEM back scattered electron image of a prior art arc-melted and annealed MnBi alloy.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Except where expressly indicated, all numerical quantities in this description indicating dimensions or material properties are to be understood as modified by the word "about" in describing the broadest scope of the present disclosure.

The first definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

Reference is being made in detail to compositions, embodiments, and methods of the present invention known to the inventors. However, it should be understood that disclosed embodiments are merely exemplary of the present invention which may be embodied in various and alternative forms. Therefore, specific details disclosed herein are not to be interpreted as limiting, rather merely as representative bases for teaching one skilled in the art to variously employ the present invention.

The description of a group or class of materials as suitable for a given purpose in connection with one or more embodiments of the present invention implies that mixtures of any two or more of the members of the group or class are suitable. Description of constituents in chemical terms refers to the constituents at the time of addition to any combination specified in the description, and does not necessarily preclude chemical interactions among constituents of the mixture once mixed. The first definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

A permanent magnet is made from a magnetized material which creates its own persistent magnetic field. Permanent magnets are used in a variety of applications. For example, in green energy applications such as electric vehicles or wind turbines, neodymium-iron-boron (Nd—Fe—B) magnet has been typically utilized. For such applications, the permanent magnets have to be able to retain magnetism at high temperatures. Rare earth elements, which are capable of generating very high anisotropy field, therefore high coercivity, have been typically used to produce such permanent magnets. In addition, heavy rare earth metals have been used to enhance coercivity to stabilize permanent magnets. Yet, rare earth elements, and especially heavy rare earth metals, have a limited supply and are therefore expensive. Thus, there has been a need to develop rare-earth-free permanent magnets.

Among the various types of the rare-earth-free permanent magnets, MnBi magnet is one of the most promising materials for high temperature permanent magnet applications. The low temperature phase (LTP) of the MnBi alloy has a high magnetic crystalline anisotropy of $1.6\times10^6$ $Jm^{-3}$. The ferromagnetic LTP of the MnBi alloy has a unique feature, specifically, coercivity of the LTP of the MnBi alloy has a large positive temperature coefficient, which means that the coercivity of a magnet made from the LTP MnBi increases with increasing temperature. This unique feature makes the MnBi magnet an excellent candidate for high temperature applications to replace heavy rare earth-based permanent magnet, or at least to decrease the dependence on the heavy rare earth elements.

Yet, the saturation magnetization of the MnBi alloy is relatively low at about 0.9 T at 300 K. The MnBi alloy is usually composed of other phases such as non-magnetic Mn and Bi, which are phases that do not contribute to the magnetic property. The MnBi magnet can be either used directly as a permanent magnet or for exchange coupling nanocomposite magnets. A prerequisite for all the applications is high purity MnBi LTP. But achieving high volume ratio of the MnBi LTP in the MnBi alloy has been problematic.

Conventional metallurgical methods such as arc melting and sintering are economically feasible, but the MnBi alloy prepared by these methods contains a relatively high volume of non-magnetic Mn and Bi phases because the reaction between Mn and Bi is peritectic such that a solid phase and a liquid phase form a second solid phase at a certain temperature. During solidification, Mn solidifies first out of the MnBi liquid. A heat treatment or annealing is performed at low temperature to get the MnBi LTP. Yet, the volume ratio of the LTP MnBi is limited by the nature of the peritectic reaction and by the low reaction temperature. The reaction between Mn and Bi is slow, and the volume ratio of the MnBi LTP is typically not higher than 90% even after various heat treatments. Any heat treatment may be cost-prohibitive considering the time and temperature needed. An example MnBi alloy prepared by arc melting and annealing is depicted in FIG. 1. The depicted MnBi alloy composite material shows the MnBi LTP in dark gray color and the non-magnetic unreacted metal Bi phase in light gray color.

It is not cost-effective to improve the volume ratio of the LTP MnBi by a prolonged heat treatment or by rapid solidification. Therefore, there exists a need for a process capable of producing a MnBi alloy having a ratio of MnBi LTP higher than 90 vol. %.

In one or more embodiments, a method of increasing volume ratio of magnetic particles in a MnBi alloy is disclosed. The advantage of the process described herein lies in the ability to utilize a MnBi alloy prepared by known methods such as arc-melting and annealing, and containing a no-magnetic phase, and increase the MnBi LTP of such alloy powder so that the alloy powder becomes suitable for the permanent magnet applications.

The method utilizes a jet miller being fed with a MnBi alloy powder which contains both magnetic and non-magnetic particles or phases. The gas flow parameters of the jet miller are set in such a way that the magnetic particles exit the jet miller while the non-magnetic particles remain in the jet miller. As a result, the magnetic and non-magnetic phases are separated, and the magnetic particles which exited the jet miller first represent the magnetic MnBi LTP which may be utilized as a permanent magnet, for example. Since the non-magnetic particles, or a majority of the non-magnetic particles, remains in the jet miller, the purity or volume ratio of the MnBi LTP within the particles which existed the jet miller is higher than 90 vol. %.

Figure 2:
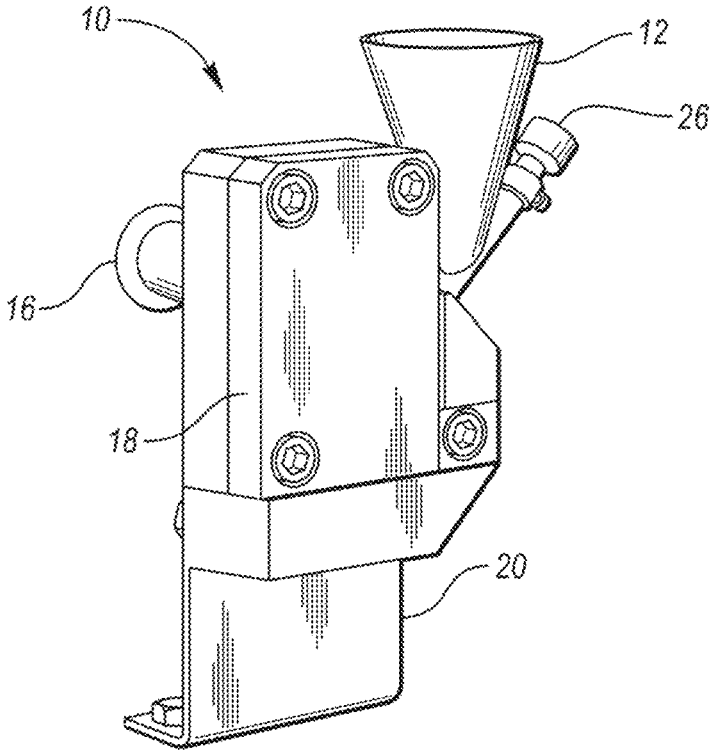
FIG. 2 depicts an example jet miller.
Figure 3:
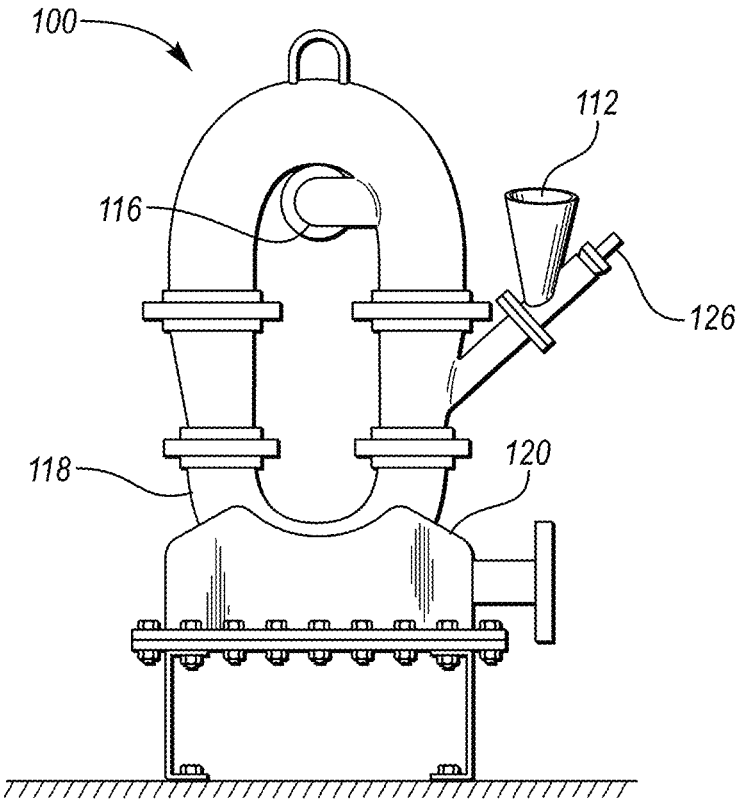
FIG. 3 depicts another example jet miller.

A jet miller, a jet milling machine, or a jet mill used for the method described herein may be any suitable jet mill or a similar apparatus using wind power and having controllable gas flow parameters. An example jet miller 10 is depicted in FIG. 2. An alternative example of a jet miller 100 is depicted in FIG. 3. Generally, the jet miller 10, 100 has an inlet 12, 112 via which an initial alloy powder 14 is delivered into the internal portions of the jet miller 10. The inlet 12, 112 may be a hopper. Likewise, the jet miller 10, 100 has an outlet 16, 116 through which the milled and/or separated alloy particles exit. In addition, the jet miller 10, 100 includes a grinding nozzle 18, 118, and a pushing nozzle 20, 120. Both the jet millers 10, 100 depicted in FIGS. 2 and 3 include the nozzles 18, 118 and 20, 120 integrated inside of steel plates.

Figure 4:
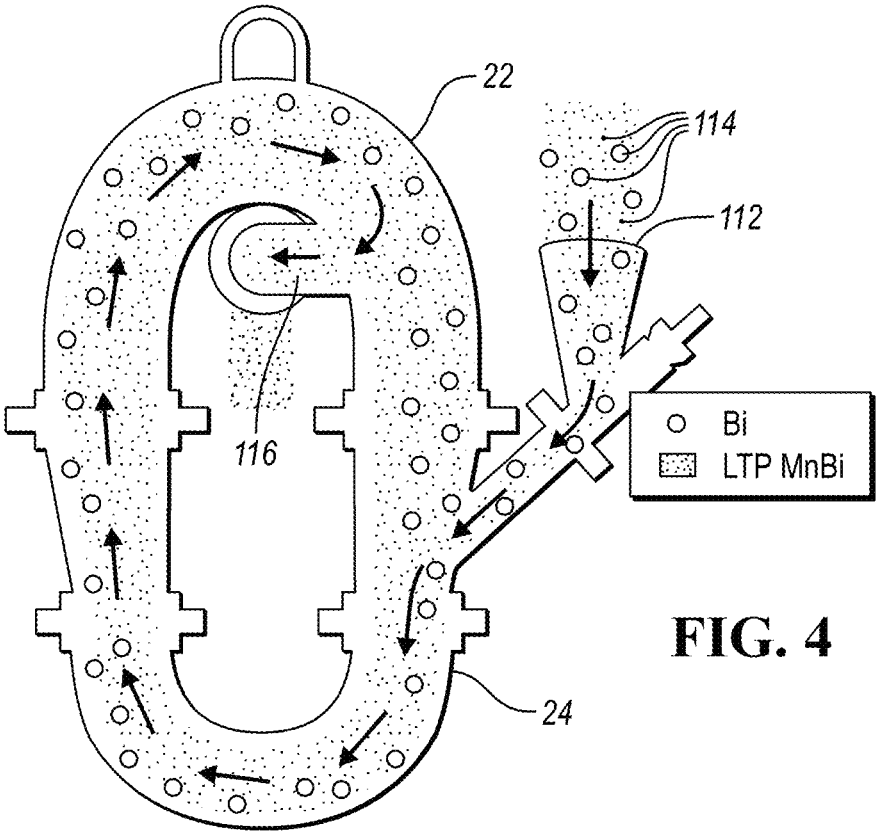
FIG. 4 schematically illustrates a cross-section of an internal chamber of the jet miller depicted in FIG. 3.

The jet miller 10, 100 has an internal chamber 22 (not depicted in FIGS. 2 and 3) through which the alloy powder 14 may circulate one time or repeatedly. The internal chamber 22 may have a cross-section which is circular, round, oval, symmetrical, asymmetrical, regular, irregular, or the like. An example cross section of the chamber 22 is depicted in FIG. 4. The alloy powder 14 enters the inlet 112 and continues to the internal chamber 22, where the powder may circulate for a number of turns. The number of turns may differ, depending on the internal structure of the jet miller, the parameters set on the jet miller, the amount and properties of the alloy powder, and other conditions. FIG. 4 schematically depicts the trajectory of the Bi particles and the MnBi LTP. The alloy particles are being carried by means of gas 24 through the internal portions of the jet miller 10, 100. The compressed gas 24 is provided via a gas port 26, 126. The compressed gas 24 may be an inert gas such as $N_2$, Ar, He, Ne, or the like. A reactive gas may not be used because a reactive gas may cause severe oxidation and ruin the magnetic properties of the powder.

The jet milling process is used to reduce the size of particles and/or separate the particles through turbulence created by the grinding nozzle 18, 118 and the compressed gas 24. The jet miller 10, 100 is used to classify the particles according to their size and density. In a jet miller 10, 100, the particles are moving along different trajectories. The trajectories are determined by two dominant forces acting on the particles: the centrifugal force and the gas drag force. The gas drag force is caused by the gas flow in the radial direction towards the outlet 16, 116. If the gas drag force is greater than the centrifugal force, the particles are exiting the chamber 22 with the gas 24. The gas drag force and centrifugal force can be calculated according to the following expressions:

$$F_d = \frac{\pi}{8} C_D \rho_A v_r^2 d^2 \tag{1}$$

$$F_c = \frac{\pi}{6} \rho_p d^3 \frac{v_t^2}{r} \tag{2}$$

$F_d$ and $F_c$ are gas drag force and centrifugal force, respectively. $C_d$ is a drag coefficient, d is the particle diameter, $v_r$ is the radial air velocity, $\rho_A$ is the air density, $\rho_p$ is the particle density, $v_t$ is the tangential air velocity, and r is the radial position of the particle.

The method utilizes density difference between different phases of the MnBi alloy powder. Particles of lower density and smaller size exit the internal chamber 22 first. In the MnBi alloy, the MnBi LTP particles have lower density than the particles of the non-magnetic phase. In addition, the MnBi LTP is brittle while Bi is more ductile. The MnBi LTP particles have a smaller diameter and lower density, therefore can be collected by dedicated control of the grinding nozzle 18, 118, the pushing nozzle 20, 120 pressure, and/or setting smaller cut size, which is the particle size at which the centrifugal force and the gas drag force reach equilibrium.

Thus, to separate the magnetic MnBi LTP particles from the non-magnetic particles such as Bi particles, the gas flow parameters need to be set in such a way that the gas drag force is greater than a centrifugal force within the jet miller 10, 100 for the MnBi LTP particles. For a given miller cut size, the magnetic particles are being separated from the non-magnetic particles as long as the pushing nozzle pressure and the grinding nozzle pressure fall within a predefined set of values. The predefined set of values depends on the type and size of the jet miller 10, 100, the dimensions and geometry of the internal chamber 22, the size of the powder particles, and other process conditions such as a number of nozzles, operating temperature, the like, or a combination thereof. Different settings of the parameters lead to different volume ratio results. In general, at high grinding nozzle pressure, the volume ratio of the MnBi LTP is the same as in the initial alloy powder 14. Lowering the grinding nozzle pressure and/or the pushing nozzle pressure may lead to a higher volume MnBi LTP ratio. The high and low pressure referenced herein is in relation to possible margin values of the nozzles. For example, high pressure may generally relate to about 120 Psi and higher. The grinding nozzle pressure may have a lower limit than the pushing nozzle pressure. Example set values to achieve a desired volume ratio of MnBi LTP in the powder exiting the outlet 16, 116 for a typical jet miller 10, 100 may be about 20 to 150, 40 to 120, or 50 to 100 Psi for the pushing nozzle pressure and about 5 to 200, 20 to 150, or 50 to 100 Psi for the grinding nozzle pressure.

The MnBi alloys can be prepared by arc-melting of a mixture of Mn and Bi with a molar ratio of about 1:1. But a MnBi alloy prepared by other methods may be likewise suitable. Different ratios of Mn:Bi are contemplated. For example, the MnBi alloy may have a ratio of Mn:Bi of about 0.5:1, 1:1, 1:1.5, 1:2, 1:2.5, 1:3, 1:4, 1:5, 1:6, 1:7, 1:8, 1:9, 1:10 or 10:1, 9:1, 8:1, 7:1, 6:1, 5:1, 4:1, 3:1, 2.5:1, 2:1, 1.5:1, 1:1, 1:0.5, or the like. A higher Bi content may be beneficial such that there would be no extra Mn, and non-magnetic Bi would be the phase that needs to be eliminated from the alloy material. Alternatively, when Mn content is increased such that there is extra Mn in the alloy after phase transition, the extra Mn is the phase to be separated using jet milling.

The alloy may be annealed at temperatures between about 200° C. to 700° C., 260° C. and 500° C., 300° C. and 400° C. for about 6 to 48 hours, 12 to 40 hours, o 18 to 24 hours. The annealed alloy may be shaped into an ingot. The annealed alloy can be crushed and/or milled into a powder having a particle size of about 1 μm to several hundred μm such as 500 μm. The crushing may be conducted mechanically or manually. The particle size of the powder may be about 1 μm to about 500 μm, 100 μm to 400 μm, or 200 μm to 300 μm. The powder may be jet milled to separate the non-magnetic phase such as Bi from the MnBi LTP, and to improve the weight ratio of MnBi LTP powder. Thus, the jet miller 10, 100 may be used just for separation of the magnetic and non-magnetic phase in an already-crushed powder. Alternatively, the crushing/milling may be provided by the jet miller 10, 100. Alternatively still, an already-crushed powder particles may be further reduced in size in the jet miller 10, 100. In another embodiment, the alloy may be ball-milled, and/or cryo-milled before being used as the input alloy powder 14 in the jet-milling process described herein.

The jet milling process may be used to separate Bi or Mn from the MnBi LTP under protective atmosphere such as $N_2$, Ar, He, or other inert gas. By adjusting the pushing nozzle 18, 118 and the grinding nozzle 20, 120 pressure, the MnBi LTP weight ratio of the powder exiting the jet miller 10, 100 may be adjusted and increased such that the powder exiting the outlet 16, 116 first may have a higher volume ratio of MnBi LTP compared to the initial alloy powder 14 entering the inlet 12, 112.

It is understood that certain amount of non-magnetic particles may exit the outlet 16, 116 with the MnBi LTP particles. Yet, setting the parameters as described herein minimizes the amount of the non-magnetic particles exiting the jet miller together with the MnBi LTP.

The gas flow parameters may be set before the jet milling starts. One or more of the gas flow parameters may be adjusted one or more times during the jet milling process. Alternatively, the adjusting of the gas flow parameters may be gradual throughout the entire process or during a portion of the process. The jet milling process may be conducted for a period of time. The period may be predefined prior to the start of the jet milling process. The predefined time period may be several seconds to several minutes. For example, the predefined time period may be 20 s, 30 s, 45 s, 1, 2, 4, 5, 6, 8, 10, 12, 15, 30 minutes.

Once the powder with the increased MnBi LTP weight ratio exits the outlet 16, 116, it is possible to separately collect the remaining powder having a higher ratio of the non-magnetic phase compared to the initial alloy powder 14. To collect the remaining powder, the gas flow parameters may be adjusted such that a gas drag force is greater than a centrifugal force for the non-magnetic phase within the jet miller 10, 100. Alternatively, the chamber can be opened directly to collect the remaining powder. The collected remaining powder may contain up to or at least about 50, 60, 70, 80, 90, 95, 99, 100 volume % of non-magnetic phase. Since there is no contamination of the powders during the jet milling process, all the powder with MnBi LTP ratio lower than a desirable value may be recycled. Such powder rich in the non-magnetic phase may serve as a starting component for a new mixture to be arc-melted or sintered into a new MnBi alloy. For example, if the collected non-magnetic phase is Bi, the Bi may be mixed with Mn and annealed to provide a new MnBi alloy which may be then cryo-milled, crushed, milled, jet milled, and separated according to the process described herein. Thus, the method is very useful for mass production of powder having a desirable volume ratio of the LTP.

The powder with the increased MnBi LTP volume ratio which exits the outlet 16, 116 may be the final product. The final product is thus gained in one cycle. Alternatively, the same powder may be returned to the jet miller 10, 100 and be separated again. Repeating the jet milling operation may even further increase the volume ratio of the MnBi LTP in the powder. The process may be repeated one or more times. The process can thus last 1, 2, 3, 4, 5, 8, 10, 15 cycles or more. At least one of the selected gas flow parameters may be adjusted before, during, and/or after the jet milling operation is repeated. For example, at least one of the gas flow parameters may be lowered or increased before, during, or after at least one of the cycles.

The desirable volume ratio of the MnBi LTP in the powder achievable by the process described herein may be up to about 99 vol. %. The volume ratio of the MnBi LTP in the powder achievable by the process described herein may be at least about 90, 91, 92, 93, 94, 95, 95.5, 96, 96.5, 97, 97.5, 98, 98.5, 99 vol. %. The volume ratio of the MnBi LTP in the powder achievable by the process after one cycle may be at least about 75, 80, 85, 88, 90, 90.5, 91, 91.5, 92, 92.5, 93, 93.5, 94, 94.5, 95 vol. %. For example, a volume ratio of the LTP of a powder which exits the outlet 16, 116 may be about 75, 80, 85, 88, 90, 90.5, 91, 91.5, 92, 92.5, 93, 93.5, 94, 94.5, 95, 95.5, 96, 96.5, 97, 97.5, 98, 98.5, or 99 vol. % or more after one or more cycles.

EXAMPLE

A MnBi powder with atomic ratio of Mn:Bi being 1:1 was arc-melted and subsequently annealed at 360° C. for 24 hours. The MnBi alloy was then manually crushed into a powder having a particle size of about 500 μm. The powder was separated into 3 samples: a, b, and c. Each sample was jet-milled using a different set of parameters and collected after 2 minutes of jet milling. Table 1 below shows the pushing nozzle and grinding nozzle pressure settings for each sample.

TABLE 1

Jet milling parameter settings for samples a, b, and c

| Sample No. | Pushing Nozzle Pressure [Psi] | Grinding Nozzle Pressure [Psi] |
|---|---|---|
| a | 60 | 80 |
| b | 60 | 50 |
| c | 60 | 20 |

Figure 5:
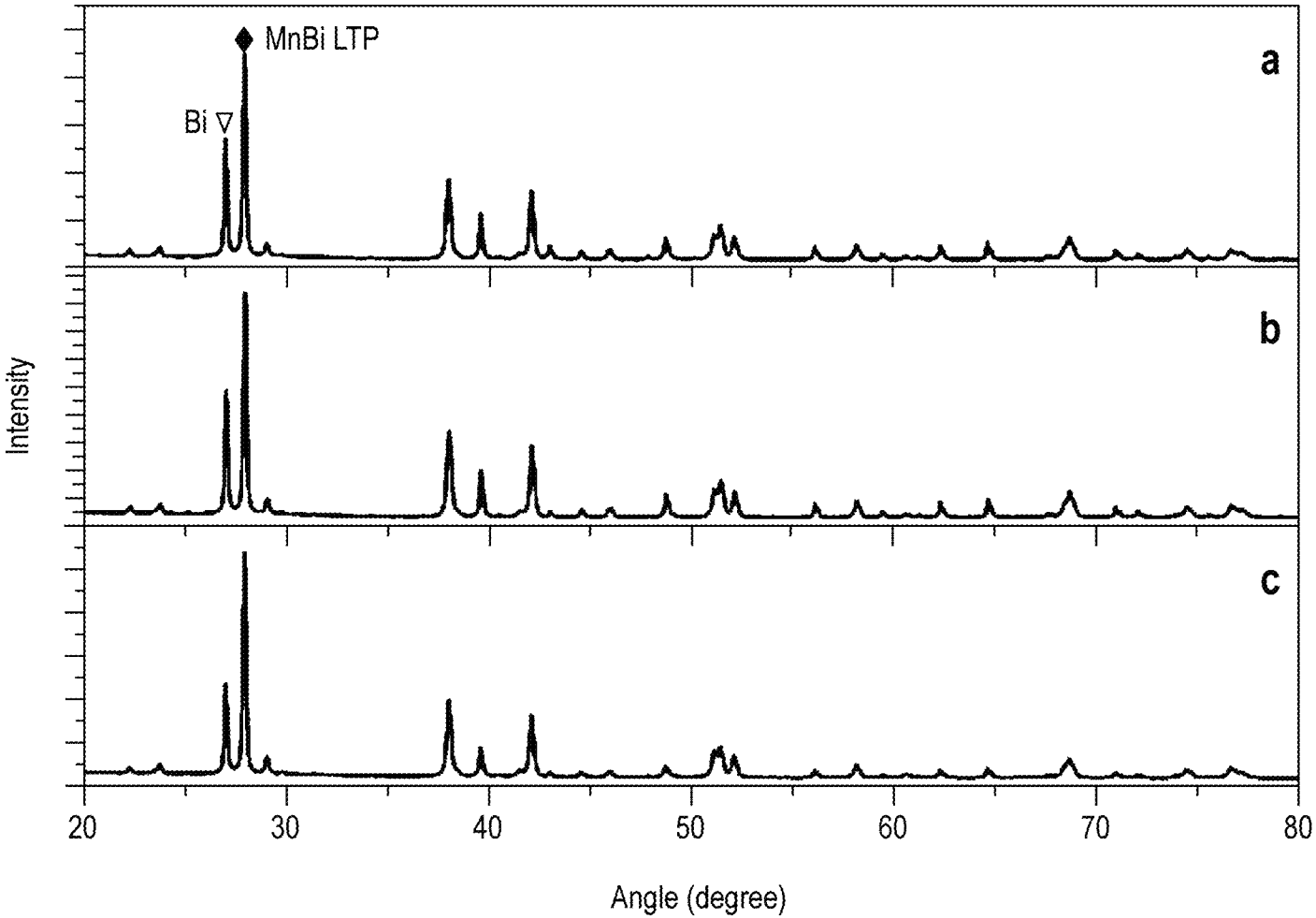
FIG. 5 shows X-ray diffraction patterns of MnBi powders jet milled using different flow gas pressure settings.

The sample powders a, b, and c were collected and characterized using X-ray diffraction. The results are shown in FIG. 5. The X-ray diffraction shows peak patterns for magnetic LTP and non-magnetic Bi in the samples a, b, and c jet-milled under different gas pressure settings.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A method of increasing volume ratio of magnetic particles in a MnBi alloy comprising:

operating a jet miller having a pushing nozzle supplying a gas at a first pressure and a grinding nozzle supplying a gas at a second pressure, wherein the jet miller is fed with a MnBi alloy powder including magnetic particles and non-magnetic particles, wherein the magnetic particles have a smaller particle diameter than the non-magnetic particles, wherein the first pressure is higher than the second pressure, wherein a gas drag force on the magnetic particles on the magnetic particles is greater than a centrifugal force within the jet miller to separate the magnetic particles from the non-magnetic particles.

2. The method of claim 1, wherein the gas drag force and centrifugal force magnetic acting on the particles in the jet miller are determined as follows:

$$F_d = \frac{\pi}{8} C_D \rho_A v_r^2 d^2$$

$$F_c = \frac{\pi}{6} \rho_p d^3 \frac{v_t^2}{r}$$

wherein $F_d$ and $F_c$ are gas drag force and centrifugal force, respectively. $C_d$ is a drag coefficient, d magnetic is the particle diameter, $v_r$ is the radial air velocity, $\rho_a$ is an air density, $\rho_p$ is the particle density, $v_t$ is a tangential air velocity, and r is a radial position of the particle.

3. The method of claim 1, wherein the MnBi alloy powder is crushed and has a magnetic particle size between about 100 μm and 500 μm.

4. The method of claim 1, wherein the magnetic particles have a lower density than the non-magnetic particles.

5. The method of claim 1, wherein the separated magnetic particles comprise up to 95 volume % magnetic phase.

6. The method of claim 1, wherein the jt miller is operated for a predefined time period.

7. A method of separating magnetic and non-magnetic phases in a MnBi alloy comprising:

operating a jet miller fed with a MnBi alloy powder containing magnetic particles and non-magnetic particles with a selected pushing nozzle pressure higher than a selected grinding nozzle pressure, wherein only for the magnetic particles, a gas drag force is greater than a centrifugal force within the jet miller, and only for non-magnetic particles, the gas drag force is lower or equal to the centrifugal force within the jet miller to separate the magnetic particles from the non-magnetic particles; and collecting the separated magnetic particles.

8. The method of claim 7, further comprising adjusting the selected pushing nozzle pressure, and the selected grinding nozzle pressure.

9. The method of claim 8, further comprising gradually adjusting the pushing nozzle pressure and the grinding nozzle pressure.

10. The method of claim 7, further comprising collecting the non-magnetic particles, combining the non-magnetic particles with Mn to form a powder mixture, annealing the powder mixture to obtain a MnBi alloy comprising magnetic and non-magnetic phases, and crushing the MnBi alloy to form a crushed powder and repeating the step of operating the jet miller with the crushed powder to separate the magnetic and non-magnetic phases.

11. A method of producing a MnBi alloy comprising up to 97 volume % magnetic phase, the method comprising:

operating a jet miller fed with a MnBi alloy powder containing magnetic particles having a first density and non-magnetic particles having a second density greater than the first density of the magnetic particles with gas flow through a pushing nozzle and a grinding nozzle being selected such that a grinding nozzle pressure is less than a pushing nozzle pressure, only for the magnetic particles, a gas drag force acting on the magnetic and non-magnetic particles is greater than a centrifugal force acting on the magnetic and non-magnetic particles within the jet miller to separate the magnetic particles from the non-magnetic particles;

collecting the magnetic particles having up to 95 volume % of magnetic phase; and repeating the step of the operating miller with the magnetic particles to increase volume % of the magnetic phase to up to 97 volume %.

12. The method of claim 11, wherein the gas flow through the pushing nozzle is supplied at the pushing nozzle pressure and the gas flow through the grinding nozzle is supplied at the grinding nozzle pressure depending, in part, upon the magnetic and non-magnetic particle size.

13. The method of claim 12, wherein the grinding nozzle pressure has a lower limit as compared with the pushing nozzle pressure.

14. The method of claim 11, further comprising changing at least one of a selected grinding nozzle pressure and a selected pushing nozzle pressure before repeating the step of operating the jet miller.

15. The method of claim 11, wherein the magnetic particles have a smaller diameter than the non-magnetic particles.

* * * * *